US007028524B1

(12) United States Patent
Brown et al.

(10) Patent No.: US 7,028,524 B1
(45) Date of Patent: Apr. 18, 2006

(54) PICK AND PLACE SYSTEM

(75) Inventors: Richard Brown, Anaheim, CA (US); Michael Kenneth Walker, Seal Beach, CA (US)

(73) Assignee: Omni-Lite Industries International, Inc., Christchurch (BB)

( * ) Notice: Subject to any disclaimer, the term of this patent is extended or adjusted under 35 U.S.C. 154(b) by 208 days.

(21) Appl. No.: 10/690,808

(22) Filed: Oct. 22, 2003

(51) Int. Cl.
*B21D 22/00* (2006.01)

(52) U.S. Cl. ..... 72/361; 72/422; 72/426

(58) Field of Classification Search ..... 72/361, 72/422, 405.09, 405.11, 426, 427, 405.13, 72/405.16; 470/154, 95, 109
See application file for complete search history.

(56) References Cited

U.S. PATENT DOCUMENTS 3,965,718 A * 6/1976 Kline ..... 72/405.15
4,398,408 A * 8/1983 Wisebaker et al. ..... 72/422
5,713,236 A * 2/1998 Genet et al. ..... 72/405.15

FOREIGN PATENT DOCUMENTS

DE 3523323 A1 * 1/1986

* cited by examiner

*Primary Examiner*—Derris H. Banks
*Assistant Examiner*—Debra Wolfe
(74) *Attorney, Agent, or Firm*—Edward P. Dutkiewicz

(57) ABSTRACT

A wall has a fixed support plate and a die face. A transfer housing and an air cylinder have a cylindrical rod horizontally secured to the support plate. The housing and air cylinder are laterally reciprocable upon the rod. Fingers have lower free ends for receiving a workpiece to be cold forged and delivering the workpiece to a die. The fingers have an upper follower. The follower is vertically reciprocable to move the fingers between an expanded orientation for releasing the workpiece and a contracted orientation for retaining the workpiece.

3 Claims, 5 Drawing Sheets

PICK AND PLACE SYSTEM

BACKGROUND OF THE INVENTION

1. Field of the Invention

The present invention relates to a pick and place system and more particularly pertains to accepting workpieces to be cold forged and delivering them to a die in an efficient and safe manner.

2. Description of the Prior Art

The use of workpiece handling systems of known designs and configurations is known in the prior art. More specifically, workpiece handling systems of known designs and configurations previously devised and utilized for the purpose of moving workpieces by conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,590,616 issued Jul. 6, 1971, to Schussler discloses a means for controlling the movements of a manipulator. U.S. Pat. No. 3,630,391 issued Dec. 18, 1971, to Wilson discloses a work gripper. U.S. Pat. No. 3,685,070 issued Aug. 22, 1972, to McClellan et al. discloses a forging machine transfer. U.S. Pat. No. 5,005,397 issued Apr. 9, 1991, to Hite et al. discloses a method for providing progressive formers with quick-change tooling. U.S. Pat. No. 4,898,017 issued Feb. 6, 1990, to Hite et al. discloses a quick-change tooling for progressive formers and the like. U.S. Pat. No. 5,105,649 issued Apr. 21, 1992, to Hite et al. discloses a method of producing forging machines. Note the abstract of the patent. U.S. Pat. No. 5,713,236 issued Feb. 3, 1998, to Genet et al. discloses a pick and place transfer. U.S. Pat. No. 5,762,325 issued Jun. 9, 1998, to Blatt discloses a power actuated gripper. U.S. Pat. No. 6,371,544 issued Apr. 16, 2002, to Wang discloses a workpiece transfer device for a forging machine. U.S. Pat. No. 5,519,932 issued May 28, 1996, to Kuze discloses a multi-stage automatic press and assembly machine. Finally, U.S. Pat. No. 6,247,578 to Steinhauser et al discloses a device for the automatic conveyance of workpieces on a multistage metal-forming machine tool.

While these devices fulfill their respective, particular objectives and requirements, the aforementioned patents do not describe a pick and place system that allows accepting workpieces to be cold forged and delivering them to a die in an efficient and safe manner.

In this respect, the pick and place system according to the present invention substantially departs from the conventional concepts and designs of the prior art, and in doing so provides an apparatus primarily developed for the purpose of accepting workpieces to be cold forged and delivering them to a die in an efficient and safe manner.

Therefore, it can be appreciated that there exists a continuing need for a new and improved pick and place system which can be used for accepting workpieces to be cold forged and delivering them to a die in an efficient and safe manner. In this regard, the present invention substantially fulfills this need.

SUMMARY OF THE INVENTION

In view of the foregoing disadvantages inherent in the known types of workpiece handling systems of known designs and configurations now present in the prior art, the present invention provides an improved pick and place system. As such, the general purpose of the present invention, which will be described subsequently in greater detail, is to provide a new and improved pick and place system and method which has all the advantages of the prior art and none of the disadvantages.

To attain this, the present invention essentially comprises a vertical wall. The vertical wall has an upper portion. The upper portion has a fixed support plate and a lower die face for a cold forging system.

Provided next is a transfer housing. An air cylinder is also provided. The air cylinder is coupled to the housing with cylindrical rods. The cylindrical rods are horizontally secured to the support plate. The housing and air cylinder are laterally reciprocable upon the rod.

Further provided is a pair of fingers. The fingers have lower free ends. The lower free ends have facing tips. The facing tips are formed with recesses. The recesses receive and support a flange of a workpiece. The fingers have an upper follower. The follower is vertically reciprocable to move the tips between an expanded orientation and a contracted orientation. The expanded orientation is for releasing a workpiece. The contracted orientation is for retaining a workpiece.

Provided last are lines for reciprocating the transfer housing between a workpiece accepting orientation remote from the support plate wherein the fingers are contracted and a workpiece delivering orientation adjacent to the support plate whereat the fingers are expanded.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pick and place system which has all of the advantages of the prior art workpiece handling systems of known designs and configurations and none of the disadvantages.

It is another object of the present invention to provide a new and improved pick and place system which may be easily and efficiently manufactured and marketed.

It is further an object of the present invention to provide a new and improved pick and place system which is of durable and reliable constructions.

An even further object of the present invention is to provide a new and improved pick and place system which is susceptible of a low cost of manufacture with regard to both materials and labor, and which accordingly is then susceptible of low prices of sale to the consuming public, thereby making such pick and place system economically available to the buying public.

Even still another object of the present invention is to provide a pick and place system for accepting workpieces to be cold forged and delivering them to a die in an efficient and safe manner.

Lastly, it is an object of the present invention to provide a new and improved pick and place system. A wall has a fixed support plate and a die face. A transfer housing and an air cylinder have a cylindrical rod horizontally secured to the support plate. The housing and air cylinder are laterally reciprocable upon the rod. Fingers have lower free ends for receiving a workpiece. The fingers have an upper follower. The follower is vertically reciprocable to move the fingers between an expanded orientation and a contracted orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
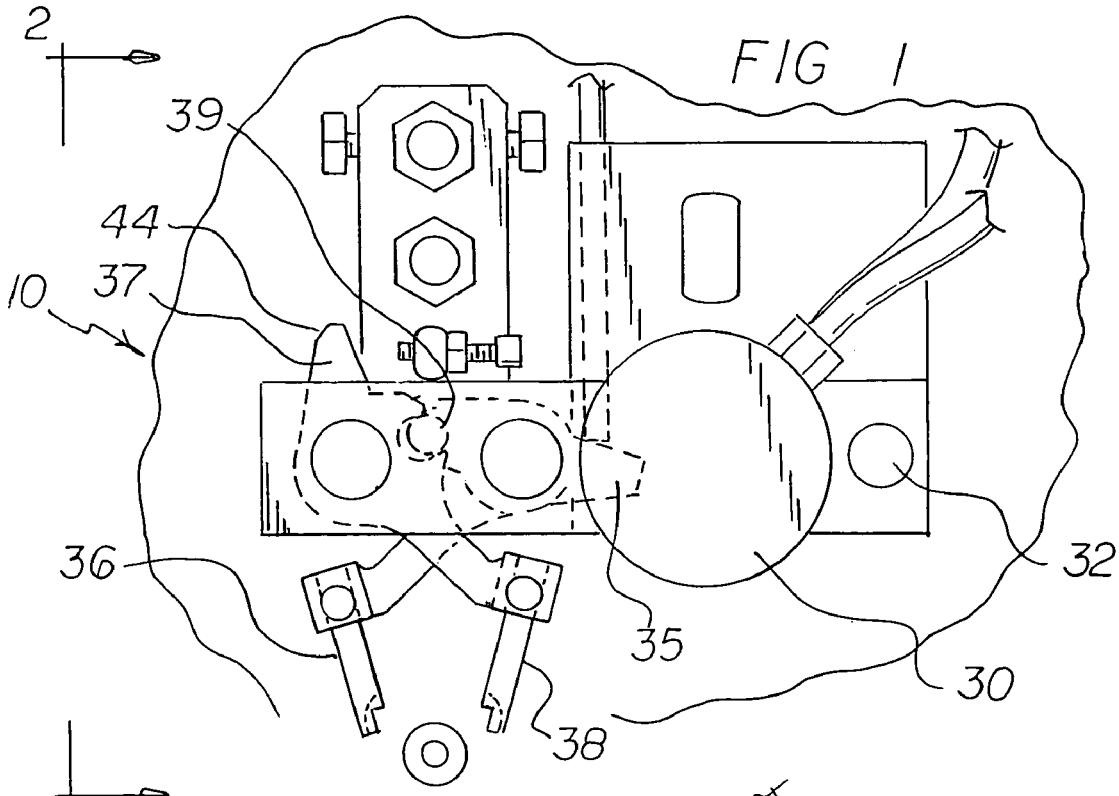
FIG. 1 is a front elevational view of a pick and place system constructed in accordance with the principles of the present invention.
Figure 2:
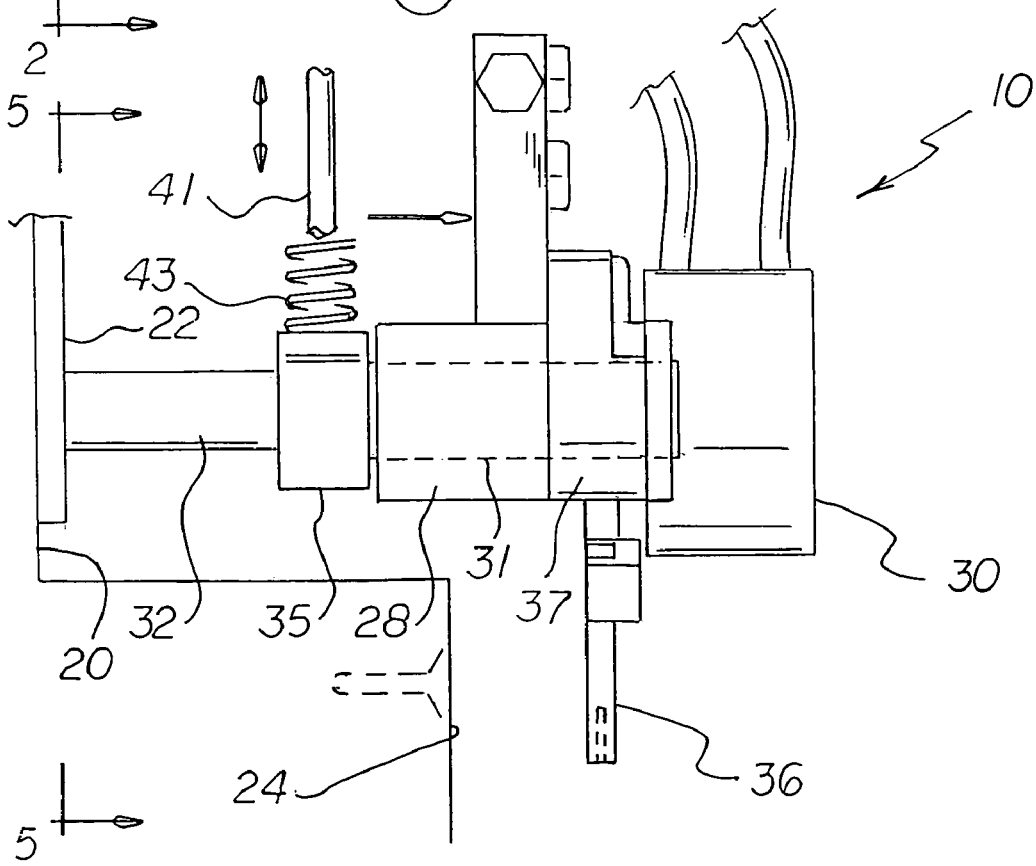
FIG. 2 is a left side elevational view taken along line 2—2 of FIG. 1 and illustrating the fingers in a retracted orientation for accepting a component to be cold forged.
Figure 3:
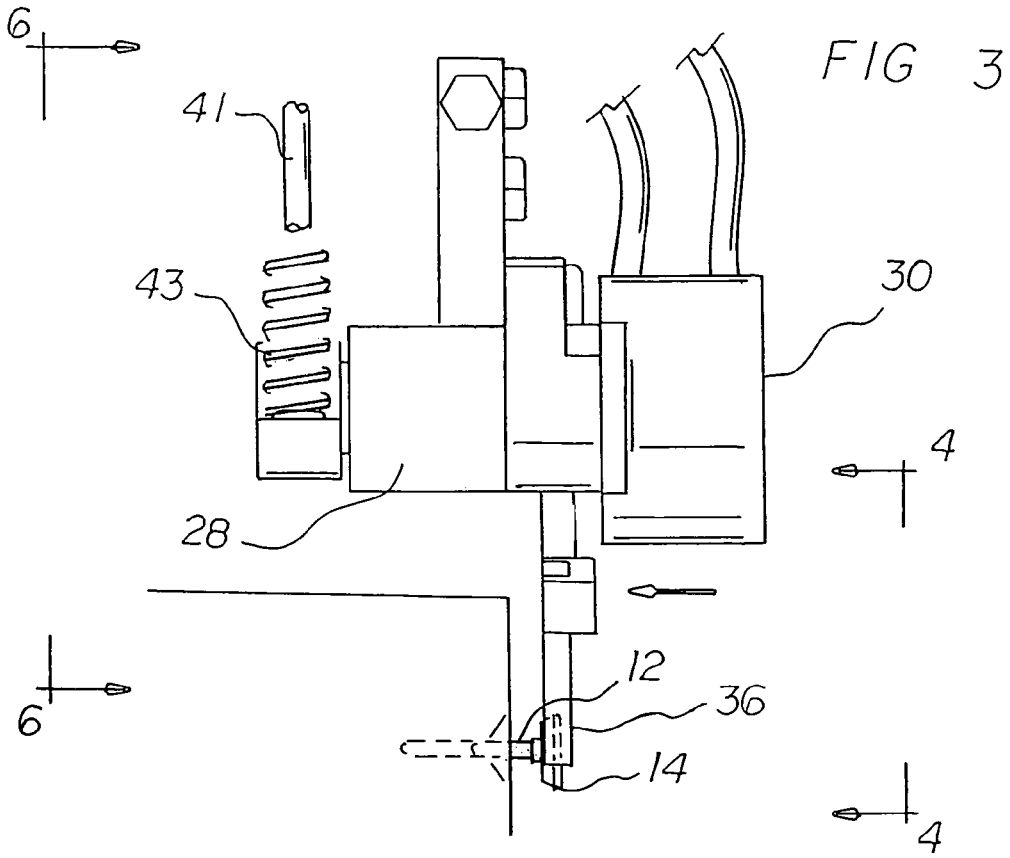
FIG. 3 is a left side elevational view similar to FIG. 2 but illustrating the fingers in an advanced orientation for delivering a component to a die face for cold forging.
Figure 4:
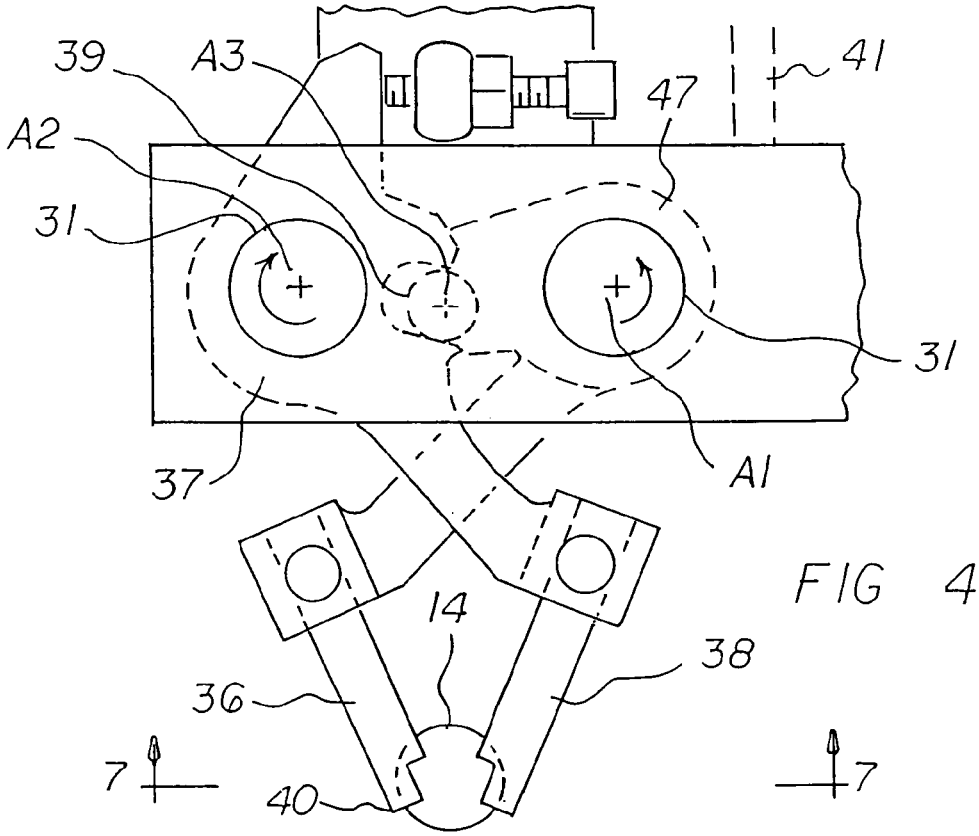
FIG. 4 is an enlarged front elevational view similar to FIG. 1 taken along line 4—4 of FIG. 3 showing the fingers contracted.
Figure 5:
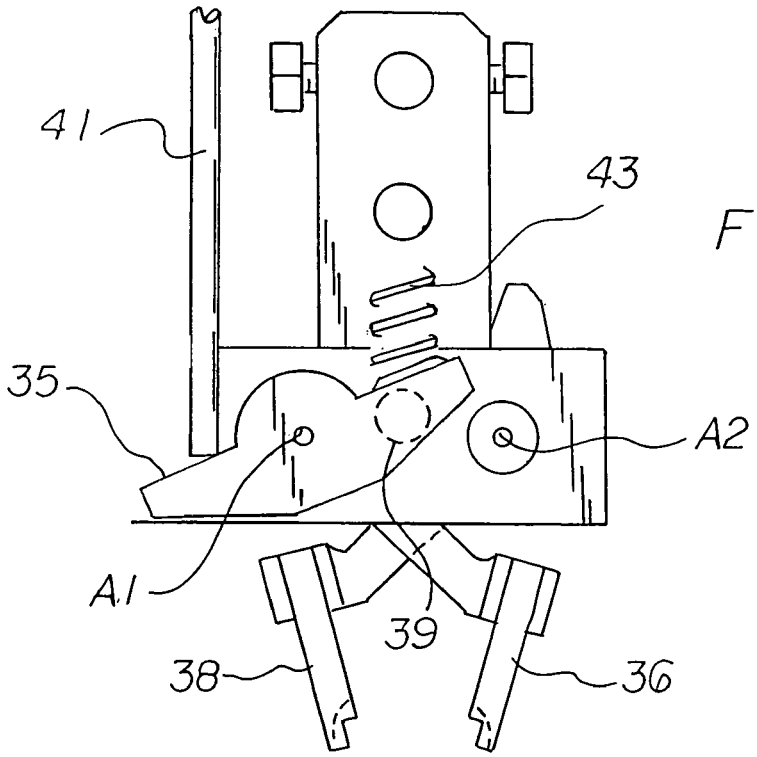
FIG. 5 is an enlarged rear elevational view taken along line 5—5 of FIG. 2 and showing the fingers retracted.
Figure 6:
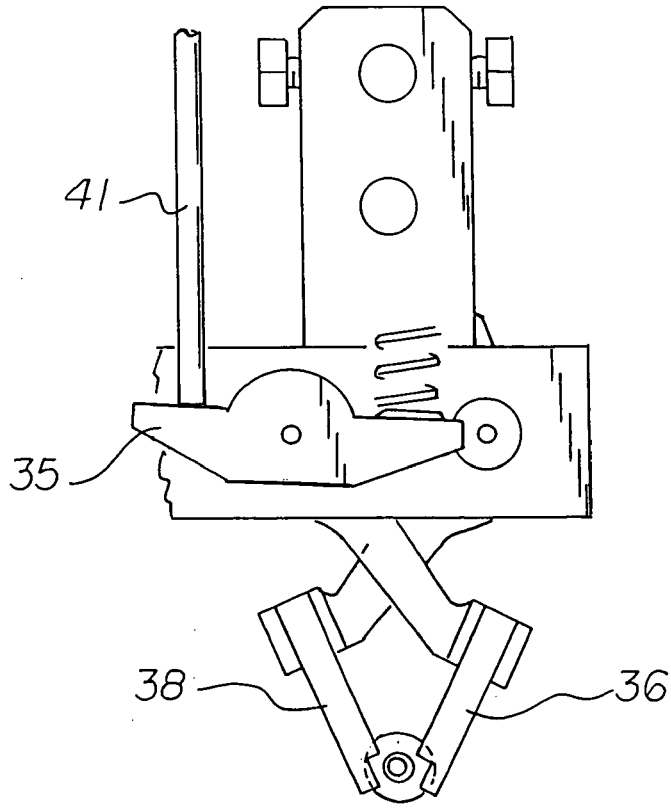
FIG. 6 is an enlarged rear elevational view taken along line 6—6 of FIG. 3 and showing the fingers contracted.
Figure 7:
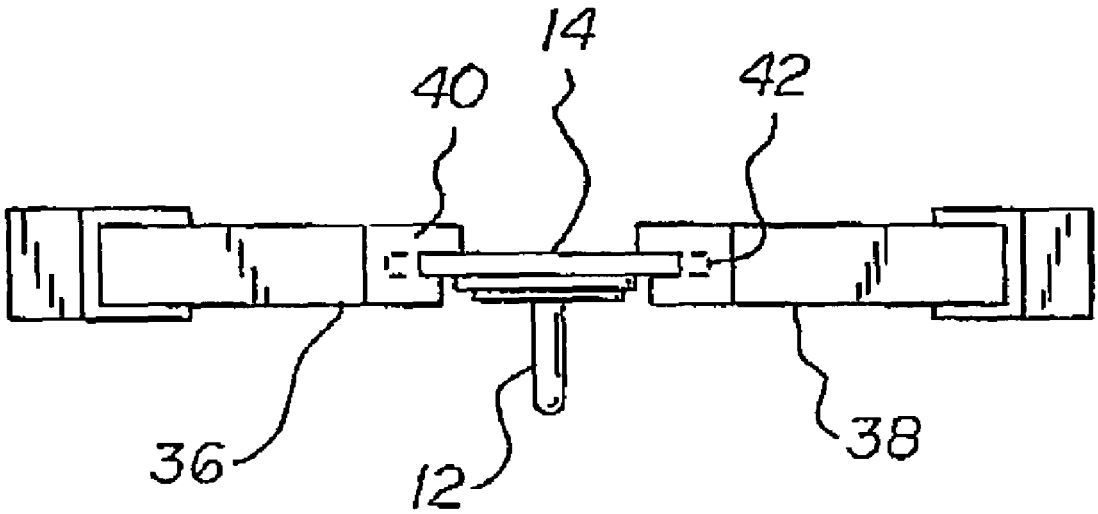
FIG. 7 is a bottom view taken along line 7—7 of FIG. 4 showing the fingers contracted.
Figure 8:
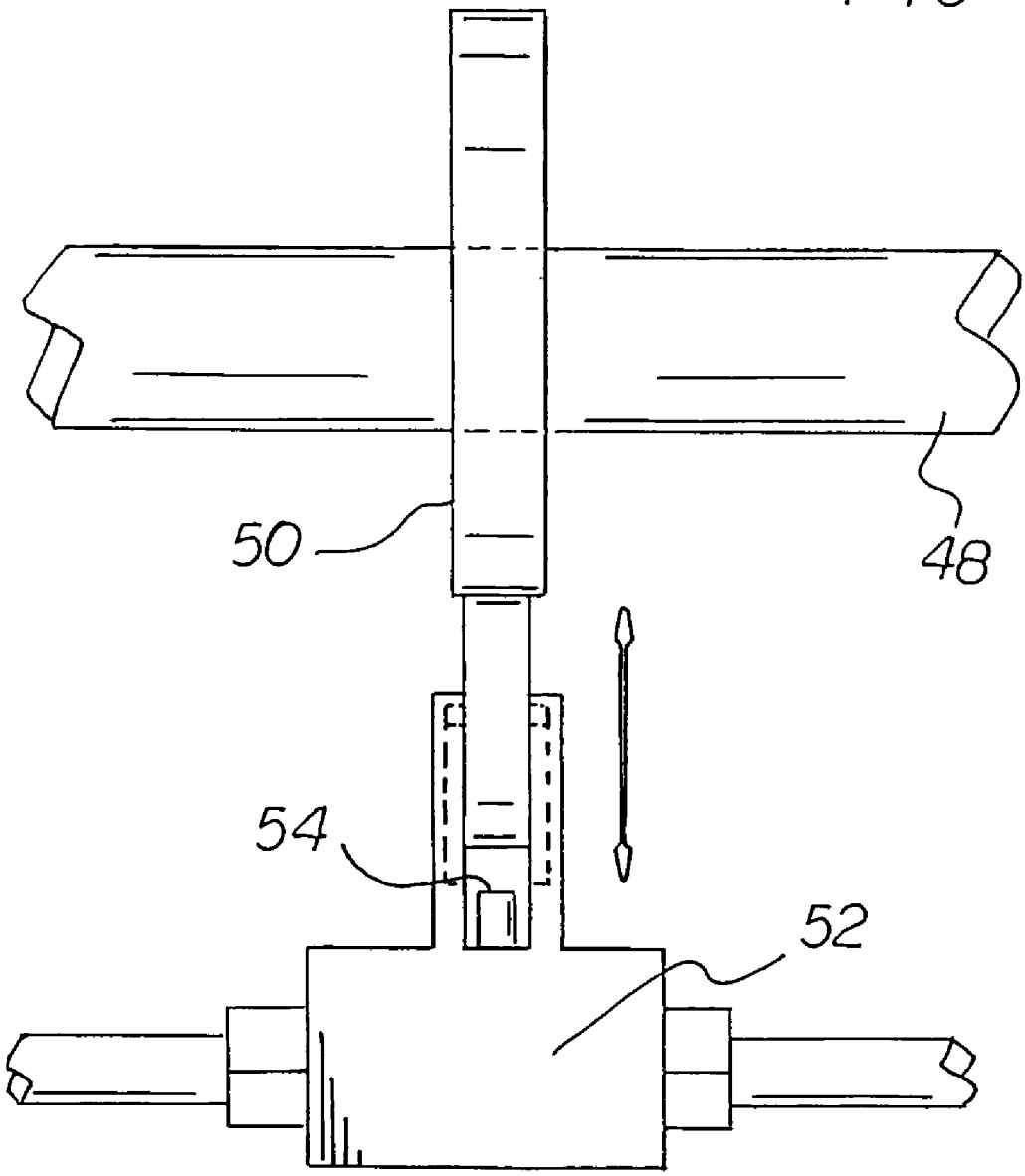

With reference now to the drawings, and in particular to FIG. 1 thereof, the preferred embodiment of the new and improved pick and place system embodying the principles and concepts of the present invention and generally designated by the reference numeral 10 will be described.

The present invention, the pick and place system 10 is comprised of a plurality of components. Such components in their broadest context include a wall, a transfer housing, and fingers. Such components are individually configured and correlated with respect to each other so as to attain the desired objective.

First provided is a vertical wall 20. The vertical wall has an upper portion. The upper portion has a fixed support plate 22 and a lower die face 24 for a cold forging system.

Provided next is a transfer housing 28. An air cylinder 30 is also provided. The air cylinder is coupled to the housing with cylindrical rods 32. The cylindrical rods are horizontally secured to the support plate. The housing and air cylinder are laterally reciprocable upon the rod.

Further provided is a pair of fingers 36, 38 which includes a driver finger 36 and a driven finger 38. The fingers have lower free ends. The lower free ends have facing tips 40. The facing tips are formed with recesses 42. The recesses receive and support a flange 14 of a workpiece 12. The fingers have an upper follower 44. The follower is vertically reciprocable to move the tips between an retracted orientation and a contracted orientation. The retracted orientation is for releasing a workpiece. The contracted orientation is for retaining a workpiece.

Movement of the fingers is caused by a driver toggle 35 coupled to one end of support shaft 31. Such shaft oscillates about axis A2. The opposite end of such shaft supports collar 47 which, in turn, oscillates the driver finger 36. Driven toggle 37 is supported upon support shaft 31 for oscillation about axis A1. The driven toggle is coupled to the driven finger 38. The toggles oscillate around parallel pivot shafts 31 which have parallel axes of oscillation A1 and A2. Oscillating pivot shaft 39 with axis A3 is attached to the collar 47 and is slidably received in a duck-bill recess of the driven toggle 37. In this manner, the oscillating movement of the driver toggle 35 and collar 47 moves the pivot shaft 39. This in turn moves the driven toggle 37 for contracting and retracting the fingers. A drive rod 41, reciprocates along its axis perpendicular to the axes of the pivot shafts to contact and pivot the driver toggle and thereby retract the fingers. A coacting coil spring 43 pivots the driver toggle oppositely upon the movement of the drive rod away from the driver toggle. Movement of the drive rod is adapted to be caused by the driving components and the main shaft of the system.

Lines function for reciprocating the transfer housing between a workpiece accepting orientation remote from the support plate wherein the fingers are contracted and a workpiece delivering orientation adjacent to the support plate whereat the fingers are retracted.

The present invention is a pick and place system. The system allows for the manufacture of very thin components in particular those with a thin collar or flange and with or without a head. These components cannot normally be manufactured by a finger transfer cold forging system. The pick and place system enhances the finger system of traditional progressive forging systems by allowing movement of the component in the longitudinal direction and accurate placement of the component in front of the die face ensuring correct alignment of the component for the next forging operation.

The system of the present invention leads to placing the part squarely into the die, preventing damage to tooling or component. The system places complex parts with square, triangular, serrated features accurately into the die allowing sequential operations to be performed on these complex parts. Subsequent operations include adding a flange or holes to the part.

Opening and closing of the air cylinder is timed by a special cam system driver off the main shaft for the knock out and transfer system. Movement of the transfer system in the longitudinal direction is controlled by a pneumatic air valve driven by the cam system. Air regulator downstream of valve controls the speed at which the air cylinder moves away and toward the die block. Modified finger transfer system with a keyway allows the adjustment of the distance the air cylinder moves from the die block. This distance can vary from ⅛ inch to 2 inches.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A pick and place system for safely and efficiently accepting workpieces with flanges to be cold forged and for delivering them to a die comprising, in combination:

a vertical wall having an upper portion with a fixed support plate and a lower die face for a cold forging system;

a transfer housing and an air cylinder coupled to the housing with cylindrical rods horizontally secured to the support plate and with the housing and air cylinder laterally reciprocable upon the rod;

a pair of fingers having lower free ends with facing tips formed with recesses for receiving and supporting a flange of a workpiece, the fingers having an upper follower, the follower being vertically reciprocable to move the tips between an expanded orientation for releasing a workpiece and a contracted orientation for retaining a workpiece; and lines for reciprocating the transfer housing between a workpiece accepting orientation remote from the support plate wherein the fingers are contracted and a workpiece delivering orientation adjacent to the support plate whereat the fingers are expanded.

2. A pick and place system comprising:

a wall having a fixed support plate and a die face;

a transfer housing and an air cylinder with a cylindrical rod horizontally secured to the support plate and with the housing and air cylinder laterally reciprocable upon the rod; and fingers having lower free ends for receiving a workpiece, the fingers having an upper follower, the follower being vertically reciprocable to move the fingers between an expanded orientation and a contracted orientation.

3. The system as set forth in claim 2 and further including lines for reciprocating the transfer housing between a workpiece accepting orientation remote from the support plate wherein the fingers are contracted and a workpiece delivering orientation adjacent to the support plate whereat the fingers are expanded.

* * * * *